US011813216B1

(12) United States Patent
Riess

(10) Patent No.: US 11,813,216 B1
(45) Date of Patent: Nov. 14, 2023

(54) MULTI-THERAPEUTIC PATIENT LIFT AND PARALLEL BARS SYSTEM

(71) Applicant: Richard Joshua Riess, Temple, TX (US)

(72) Inventor: Richard Joshua Riess, Temple, TX (US)

( * ) Notice: Subject to any disclaimer, the term of this patent is extended or adjusted under 35 U.S.C. 154(b) by 1056 days.

(21) Appl. No.: 16/535,764

(22) Filed: Aug. 8, 2019

(51) Int. Cl.
*A61G 7/10* (2006.01)
*A63B 3/00* (2006.01)

(52) U.S. Cl.
CPC ..... *A61G 7/1048* (2013.01); *A61G 7/109* (2013.01); *A61G 7/1051* (2013.01); *A61G 7/1096* (2013.01); *A63B 3/00* (2013.01); *A61G 7/1015* (2013.01); *A61G 7/1017* (2013.01); *A61G 7/1053* (2013.01); *A61G 7/1055* (2013.01); *A61G 7/1074* (2013.01)

(58) Field of Classification Search
CPC ..... A61G 7/1048; A61G 7/051; A61G 7/109; A61G 7/1096; A61G 7/1074; A61G 7/1051; A61G 7/1015; A61G 7/1017; A61G 7/1053; A61G 7/1055; A61G 7/1057; A61G 7/1059; A61G 7/1038; A61G 7/1019; A61G 7/1021; A61G 7/1023; A61G 7/1086; A61G 7/1088; A61G 7/1098; A61G 7/1094; A61G 7/1092; A61G 7/1044; A61G 2200/34; A63B 3/00; A63B 23/1227; A63B 21/00047; A63B 1/00; A63B 2225/093
See application file for complete search history.

(56) References Cited

U.S. PATENT DOCUMENTS 2,210,269 A * 8/1940 Taylor ..... A61H 1/0255 280/211
2,812,010 A * 11/1957 Abdallah ..... A61H 3/008 482/69
2,819,755 A * 1/1958 Berger ..... A61H 3/008 482/69
3,115,260 A * 12/1963 Nissen ..... B62B 5/0089 280/43.11
3,120,386 A * 2/1964 Janssen ..... A63B 3/00 403/107
3,534,955 A * 10/1970 Wieland ..... A63B 3/00 482/42
3,697,066 A * 10/1972 Wieland ..... A63B 3/00 482/42
3,999,228 A * 12/1976 Thomas ..... A61H 3/008 5/83.1
4,117,561 A * 10/1978 Zamotin ..... A61G 7/1042 5/83.1
4,555,107 A * 11/1985 Otto ..... A63B 3/00 482/42

(Continued)

*Primary Examiner* — David R Hare
*Assistant Examiner* — Morgan J McClure
(74) *Attorney, Agent, or Firm* — Plager Schack LLP; Mark H. Plager; Stephen Hallberg

(57) ABSTRACT

A multi-therapeutic patient lift and parallel bars system is disclosed. The multi-therapeutic patient lift and parallel bars system includes a patient lift system that is built into parallel bars, to lift patients who cannot stand. This multi-therapeutic patient lift and parallel bars system combines several devices together, for more room, convenience, decreased clutter, and more available storage with increased ease of moving patients around in an area that could already be crowded.

10 Claims, 8 Drawing Sheets

(56) References Cited

U.S. PATENT DOCUMENTS 4,902,000 A * 2/1990 Starks ..... A63B 3/00 482/904
4,960,276 A * 10/1990 Feuer ..... A63B 22/203 482/4
D375,767 S * 11/1996 Camfield ..... D21/668
5,662,560 A * 9/1997 Svendsen ..... A63B 71/0009 482/54
5,878,450 A * 3/1999 Bouhuijs ..... A61G 7/1046 5/83.1
5,941,800 A * 8/1999 Laconis ..... A63B 69/18 482/70
5,997,444 A * 12/1999 McBride ..... A61H 3/04 482/69
6,146,315 A * 11/2000 Schonenberger ..... A63B 22/02 482/54
6,168,548 B1 * 1/2001 Fleming ..... A63B 3/00 482/41
6,238,320 B1 * 5/2001 Flanagan ..... A63B 3/00 482/130
6,264,584 B1 * 7/2001 Bass ..... A63B 21/4009 482/69
6,689,075 B2 * 2/2004 West ..... A61H 1/0262 482/69
7,125,388 B1 * 10/2006 Reinkensmeyer ..... A63B 69/0064 601/5
7,356,858 B2 * 4/2008 Summers ..... A61G 7/1096 5/89.1
7,468,023 B2 * 12/2008 Wu ..... A61H 3/04 482/69
7,540,045 B2 * 6/2009 Nativ ..... A61H 3/04 5/89.1
7,543,341 B1 * 6/2009 Carbaugh ..... A61G 7/1076 5/81.1 RP
7,676,872 B2 * 3/2010 Block ..... A47C 31/123 5/933
8,690,803 B2 * 4/2014 Fullenkamp ..... A61H 1/0237 601/5
8,920,347 B2 * 12/2014 Bayerlein ..... A63B 21/00181 601/5
9,364,735 B2 * 6/2016 Beane ..... A63B 22/02
9,381,397 B2 * 7/2016 Orgal ..... A63B 69/0057
9,895,576 B1 * 2/2018 Orgal ..... A63B 23/0458
10,052,252 B2 * 8/2018 Lin ..... A61B 5/389
10,252,095 B1 * 4/2019 Carnahan ..... A63B 3/00
10,265,565 B2 * 4/2019 Jue ..... A63B 69/0064
D849,608 S * 5/2019 Orrell ..... A61G 7/1096 D12/131
10,342,461 B2 * 7/2019 Basta ..... A61B 5/1038
10,493,309 B2 * 12/2019 Jue ..... A63B 21/00069
10,500,122 B2 * 12/2019 Aryananda ..... A61G 7/1067
10,881,572 B2 * 1/2021 Tholkes ..... A61H 3/00
10,918,926 B2 * 2/2021 Pennington ..... A63B 21/4017
10,945,910 B2 * 3/2021 Picazo ..... A61H 1/00
11,202,934 B2 * 12/2021 Kim ..... A63B 69/0062
11,253,415 B2 * 2/2022 McKay ..... A61H 3/008
2004/0009845 A1 * 1/2004 Johnson ..... A63B 26/003 482/41
2005/0217025 A1 * 10/2005 Barattia ..... A61G 7/1046 5/81.1 R
2006/0199703 A1 * 9/2006 Shifferaw ..... A63B 23/0458 482/52
2008/0070757 A1 * 3/2008 Albert ..... A63B 71/0009 482/54
2008/0207405 A1 * 8/2008 Jung ..... A63B 3/00 482/38
2012/0001527 A1 * 1/2012 Choppla ..... G09B 19/06 312/249.8
2013/0180557 A1 * 7/2013 Triolo ..... A61G 5/14 135/66
2014/0087920 A1 * 3/2014 Nickel ..... A63B 3/00 482/41
2014/0259392 A1 * 9/2014 Chen ..... A61G 7/1042 4/573.1
2015/0257965 A1 * 9/2015 Simeone ..... A63B 22/203 482/146
2017/0156959 A1 * 6/2017 Domenick ..... A61G 7/1017
2018/0036189 A1 * 2/2018 Lingegard ..... A61G 7/1092
2019/0142670 A1 * 5/2019 Nomura ..... A61G 7/1096 5/86.1
2019/0201260 A1 * 7/2019 Isozumi ..... A61G 7/1086
2019/0224530 A1 * 7/2019 Groshek ..... A63B 1/00
2019/0314663 A1 * 10/2019 Horne ..... A63B 22/00
2020/0229999 A1 * 7/2020 Chien ..... A61G 7/1059
2020/0268588 A1 * 8/2020 Desmarais ..... A61G 7/1049
2021/0162290 A1 * 6/2021 Benson ..... A63B 23/00

* cited by examiner

MULTI-THERAPEUTIC PATIENT LIFT AND PARALLEL BARS SYSTEM

BACKGROUND

Embodiments of the invention described in this specification relate generally to physical therapy machines and systems, and more particularly, to a multi-therapeutic patient lift and parallel bars system.

Therapy gyms utilize a variety of conventional therapy equipment, machines, and/or systems (hereinafter referred to as "conventional therapy equipment") to treat patients. Examples of conventional therapy equipment include, without limitation, standing frames, parallel bars, ramps, and steps. A standing frame assists patients to stand upright for those patients who are unable to stand on their own. However, conventional standing frames are bulky, difficult to store, and difficult to maneuver around in the therapy gym. Parallel bars are typically large—ranging from six feet to over fifteen feet—and therefore have large spatial requirements for use and storage. Bariatric-sized standing frames and parallel bars are especially large, bulky, and difficult to move. Additional floor space is required for a ramp and steps, thereby further decreasing space in a therapy gym setting.

In addition to the spatial and usability issues that exist with conventional therapy equipment, the costs of such therapy devices are high, with quality conventional therapy equipment costing several thousand dollars.

Therefore, what is needed is a way to increase space in therapy gyms, which tend to be crowded with multiple therapy systems, without limiting the quality or reducing the quantity of therapy equipment and devices available to assist patients.

BRIEF DESCRIPTION

A novel multi-therapeutic patient lift and parallel bars system is disclosed. The multi-therapeutic patient lift and parallel bars system of some embodiments increases usable space in a crowded therapy gym by combining several therapy systems into one combination system. The combination of several therapy systems increases the available space in the gym for other conventional equipment, specialty equipment (machines), and patients, and allows for increased productivity, increased quantities of patients seen, attended to, and treated.

In some embodiments, the multi-therapeutic patient lift and parallel bars system combines a plurality of therapy devices into a single machine. In some embodiments, the plurality of therapy devices comprises a patient lift/walker assembly and a parallel bars apparatus. In some embodiments, the plurality of therapy devices further includes a step system. In some embodiments, the plurality of therapy devices further includes a ramp. In some embodiments, the ramp is a collapsible ramp that is built into a platform of the parallel bars apparatus. In this way, the multi-therapeutic patient lift and parallel bars system maximizes room in the therapy gym, increases convenience of using the therapy equipment, decreases clutter in the therapy gym, and provides more available storage with increased ease of moving patients around in an area that could already be crowded.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Having described the invention in general terms, reference is now made to the accompanying drawings, which are not necessarily drawn to scale, and wherein.

DETAILED DESCRIPTION

Figure 1:
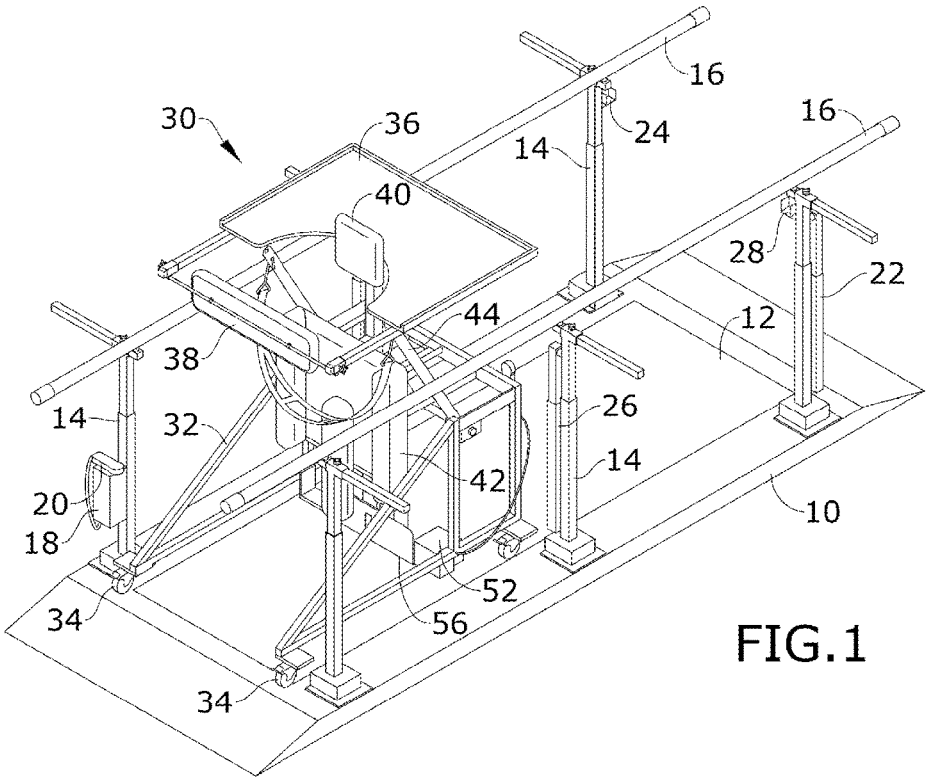
FIG. 1 conceptually illustrates a front perspective view of a first embodiment of a multi-therapeutic patient lift and parallel bars system, shown in an exemplary arrangement.

In the following detailed description of the invention, numerous details, examples, and embodiments of the invention are described. However, it will be clear and apparent to one skilled in the art that the invention is not limited to the embodiments set forth and that the invention can be adapted for any of several applications.

Some embodiments of the invention include a novel multi-therapeutic patient lift and parallel bars system is disclosed. The multi-therapeutic patient lift and parallel bars system of some embodiments increases usable space in a crowded therapy gym by combining several therapy systems into one combination system. The combination of several therapy systems increases the available space in the gym for other conventional equipment, specialty equipment (machines), and patients, and allows for increased productivity, increased quantities of patients seen, attended to, and treated.

In some embodiments, the multi-therapeutic patient lift and parallel bars system combines a plurality of therapy devices into a single machine. In some embodiments, the plurality of therapy devices comprises a patient lift/walker assembly and a parallel bars apparatus. In some embodiments, the plurality of therapy devices further includes a step system. In some embodiments, the plurality of therapy devices further includes a ramp. In some embodiments, the ramp is a collapsible ramp that is built into a platform of the parallel bars apparatus. In this way, the multi-therapeutic patient lift and parallel bars system maximizes room in the therapy gym, increases convenience of using the therapy equipment, decreases clutter in the therapy gym, and provides more available storage with increased ease of moving patients around in an area that could already be crowded.

As stated above, therapy gyms utilize a variety of conventional therapy equipment, including standing frames, parallel bars, ramps, and steps. However, most of the conventional therapy equipment items and devices are bulky, difficult to store, and/or difficult to maneuver around in the therapy gym. This has the effect of decreasing the available floor space in a therapy gym setting, which tends to make usage of some equipment difficult (for lack of sufficiently wide space). The problem is not solved by storage, since the conventional therapy equipment items and devices use vast storage space, and thus, limit the available storage or requirement greater storage space. Besides the usage and storage problems noted for the conventional therapy equipment, the costs of such therapy devices are high, with quality conventional therapy equipment costing several thousand dollars.

Embodiments of the multi-therapeutic patient lift and parallel bars system solve these problems by combining the therapy devices into a single combined system, thereby increasing the space in a therapy gym and increasing the room for more equipment, more patients. Given that many therapy gyms have limited space to begin with, the multi-therapeutic patient lift and parallel bars system also provides a safer environment which allows greater room for patients and staff to move about freely.

Embodiments of the multi-therapeutic patient lift and parallel bars system differ from the conventional therapy equipment items and devices. Specifically, the multi-therapeutic patient lift and parallel bars system combines multiple therapy devices that already exist as separate therapy devices or apparatuses. By combining multiple therapy devices into a single system, gym floor space and money are saved, without reducing effective therapy usage. In addition, the multi-therapeutic patient lift and parallel bars system decreases the need for extra storage and room for other machines. In addition to its space-saving design, some embodiments of the multi-therapeutic patient lift and parallel bars system improve upon the conventional therapy equipment items and devices by enabling combined usage by patients. Specifically, part of the parallel bars, the patient lift/walker assembly (including a "standing frame"), the step system, or the ramp can be used at the same time.

The multi-therapeutic patient lift and parallel bars system of the present disclosure may be comprised of the following elements. This list of possible constituent elements is intended to be exemplary only and it is not intended that this list be used to limit the multi-therapeutic patient lift and parallel bars system of the present application to just these elements. Persons having ordinary skill in the art relevant to the present disclosure may understand there to be equivalent elements that may be substituted within the present disclosure without changing the essential function or operation of the multi-therapeutic patient lift and parallel bars system.

1. A parallel bars platform ("platform").
2. Upright supports for parallel bars ("parallel bar uprights").
3. Two parallel bars ("parallel bars").
4. A motor for moving the parallel bars ("bar adjustment motor").
5. A patient lift/walker assembly ("lift/walker assembly").
6. A frame of the lift/walker assembly ("standing frame").
7. A hinge of the standing frame of the lift/walker assembly.
8. Locking wheel casters ("locking casters") of the lift/walker assembly.
9. A foot guard/kick plate ("kick plate with abduction board slot").
10. A collapsible (foot and) knee blocker ("knee pad") of the lift/walker assembly. The knee pad can be adjusted high or low on a small track system.
11. A collapsible chest pad ("chest pad") support of the lift/walker assembly.
12. A collapsible and motorized adjustable height tray ("adjustable height tray"). The figures do not illustrate the ability of the adjustable height tray to be collapsed or removed for standing a patient in standing frame portion. Sometimes the patient may just need to stand, using just the knee pad, without the adjustable height tray.
13. A patient lift sling/strap ("lift strap").
14. A lift sling/strap adjustment electric motor ("lift adjustment motor").
15. Parallel supports for the patient lift (hereinafter referred to as "lift arms").
16. Sliding rails for the parallel bars.
17. Remote control with cord.
18. Relay box-which the remote control is attached to.
19. An anti-scissoring board (also referred to as an "abduction board").
20. An electric motor to adjust the height of the adjustable height tray (also referred to as the "tray height adjustment motor").
21. A back brace for the tray (also referred to as the "back pad").
22. In some embodiments, a collapsible step system is built into a storage hatch of the platform. In some embodiments, the storage hatch provides access to a sub-floor underneath the therapy gym floor on which the multi-therapeutic patient lift and parallel bars system is positioned. The sub-floor can be a garage-like system in which the storage hatch provides access when opened to the sub-floor for storage of components. The collapsible step system of some embodiments is capable of making a single step for aerobic use or practice going up with a walker. In some embodiments, the collapsible step system includes a series of steps with a platform at the end which collapses down into the sub-floor via the storage hatch. In this way, the collapsible step system can simulate practice in the home and community environment.

23. In some embodiments, there is a ramp system in the parallel bars. The ramp system will raise the entire parallel bars system at one end by an electric motor or by a manual crank system. This will simulate ambulation, climbing up and down ramps, and simulate the community setting. In some embodiments, there are two ramps. There is the standard ramp and another ramp, which is more or less a smaller, starter ramp for someone to walk up and down, with parallel bars at their side. The smaller ramp is built into the floor, with the steps and platform. This is a ramp with a height of about one-two steps. In some embodiments of a remote motorized system, the smaller ramp works by popping out of the floor (or sub-floor via the storage hatch). In some embodiments, a user simply presses a button on a remote control device, or a controller of the multi-therapeutic patient lift and parallel bars system, and software or logic control instructions of the controller would activate the storage hatch to open and instruct motors of the ramp to automatically assemble the ramp above the sub-floor within the parallel bars. In this way, a patient could utilize the ramp once it comes together, instead of the steps or single step platform.

24. In some embodiments, a series of additional support bars for the hands of a patient are added for going up and down the steps (hereinafter referred to as "handrail" which is latched into place by a "handrail hook").

The various elements of the multi-therapeutic patient lift and parallel bars system of the present disclosure may include additional elements not listed above, but which are provided in one or more embodiments of the multi-therapeutic patient lift and parallel bars system. The various elements listed above and other, additional elements which are not listed above may related in the following exemplary ways, as shown and described by reference to FIGS. 1-13. However, the examples described by reference to FIGS. 1-13 are not intended to limit the scope or nature of the relationships between the various elements and, therefore, are presented as illustrative examples only.

Figure 2:
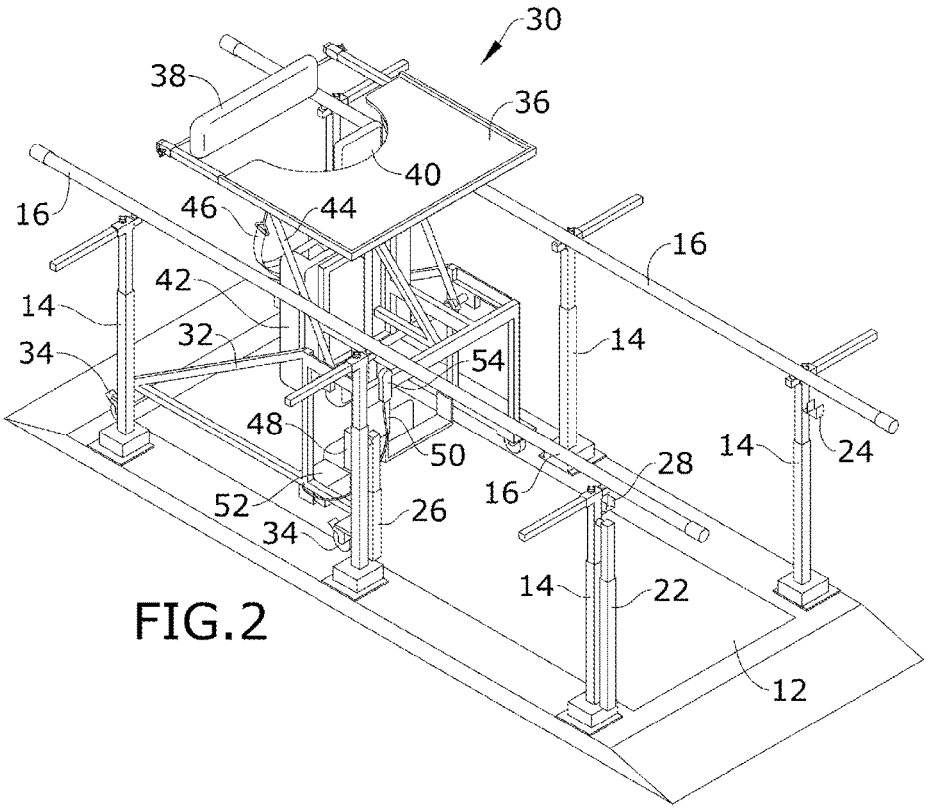
FIG. 2 conceptually illustrates a rear perspective view of a multi-therapeutic patient lift and parallel bars system in some embodiments, shown in an exemplary arrangement.

By way of example, FIG. 1 conceptually illustrates a front perspective view of a first embodiment of a multi-therapeutic patient lift and parallel bars system and FIG. 2 conceptually illustrates a rear perspective view of the first embodiment of the multi-therapeutic patient lift and parallel bars system. Both figures demonstrate an exemplary arrangement of the multi-therapeutic patient lift and parallel bars system with parallel bars and a lift-walker assembly.

Specifically, as shown from the front perspective view of the multi-therapeutic patient lift and parallel bars system in FIG. 1, the first embodiment of the multi-therapeutic patient lift and parallel bars system includes a platform 10, a storage hatch 12, parallel bar uprights 14, parallel bars 16, a bar adjustment motor 18, a bar adjustment controller 20, an end bar 22, an end bar hook 24, a handrail 26, a handrail hook 28, a lift/walker assembly 30, a frame 32 of the lift/walker assembly 30, locking casters 34, an adjustable height tray 36, a back pad 38, a chest pad 40, a knee pad 42, lift arms 44, a lift adjustment motor controller box 52, and a kick plate with abduction board slot 56.

Now as shown from the rear perspective view of a multi-therapeutic patient lift and parallel bars system in FIG. 2, the first embodiment of the multi-therapeutic patient lift and parallel bars system further includes a lift strap 46, a lift adjustment motor 48, a tray height adjustment motor 50, and a tray height adjustment motor controller 54.

In some embodiments, the platform 10 provides a standing area for a patient to stand once inside the parallel bars. In some embodiments, the platform 10 is used as a foundation for the lift/walker assembly 30 standing frame 32 and at least part of the parallel bars 16. In some embodiments, the platform 10 is made of plywood. In some embodiments, the platform 10 is made of another hard surface material similar to plywood.

In some embodiments, the storage hatch 12 provides space to store at least one of a collapsible step system and a collapsible ramp. In some embodiments, the storage hatch 12 is used to store other equipment.

In some embodiments, the parallel bar uprights 14 connect the platform 10 to the parallel bars 16. In some embodiments, the parallel bar uprights 14 are made of metal. In some embodiments, the parallel bar uprights 14 are secured to the platform 10. In some embodiments, the parallel bar uprights 14 are bolted into the platform 10. In some embodiments, the parallel bar uprights 14 are able to slide the parallel bars 16 up and down and side to side to adjust for different sizes of different patients. In some embodiments, an increased quantity of parallel bar uprights 14 are included in a multi-therapeutic patient lift and parallel bars system that utilizes a step system. In some embodiments, additional supports for the hands are integrated into the parallel bar uprights 14.

In some embodiments, the parallel bars 16 run parallel for support when a patient puts hands on the parallel bars 16 for support while walking or moving on the platform 10 along the parallel bars 16. In some embodiments, the additional supports for the hands that are integrated into the parallel bar uprights 14 are at a height of the parallel bars 16. In some embodiments, sliding bars are included in the parallel bar uprights 14 and additional supports of the lift/walker assembly 30 to allow the parallel bars 16 to move up and down or side to side. In some embodiments, a hinge is included in the lift/walker assembly 30 such that as the lift/walker assembly 30 moves forward a little, the hinge allows the lift/walker assembly 30 to swing ninety degrees to connect to the support for the parallel bars 16 on the opposing side.

In some embodiments, the bar adjustment motor 18 is an electric motor to move the parallel bar uprights 14 up and down and side to side, and thereby move the parallel bars 16 up and down and side to side. In some embodiments, manually adjustable parallel bar uprights connect the platform 10 to the parallel bars 16 and are included in alternative embodiments of the multi-therapeutic patient lift and parallel bars system instead of the bar adjustment motor 18. In some embodiments, the parallel bar uprights 14 and the parallel bars 16 are both manually adjustable and electronically adjustable by way of the bar adjustment motor 18 to give an option between motorized and manual adjustment of the parallel bar uprights 14 and the parallel bars 16.

In some embodiments, the bar adjustment controller 20 is an electronic logic control device that directs the bar adjustment motor 18 to move the parallel bar uprights 14 up and down and side to side. In some embodiments, the bar adjustment controller 20 receives input commands from a remote control device operated by a user. In some embodiments, the bar adjustment controller 20 directs the bar adjustment motor 18 to move the parallel bar uprights 14 in a particular manner according to the input command received from the remote control device.

Figure 4:
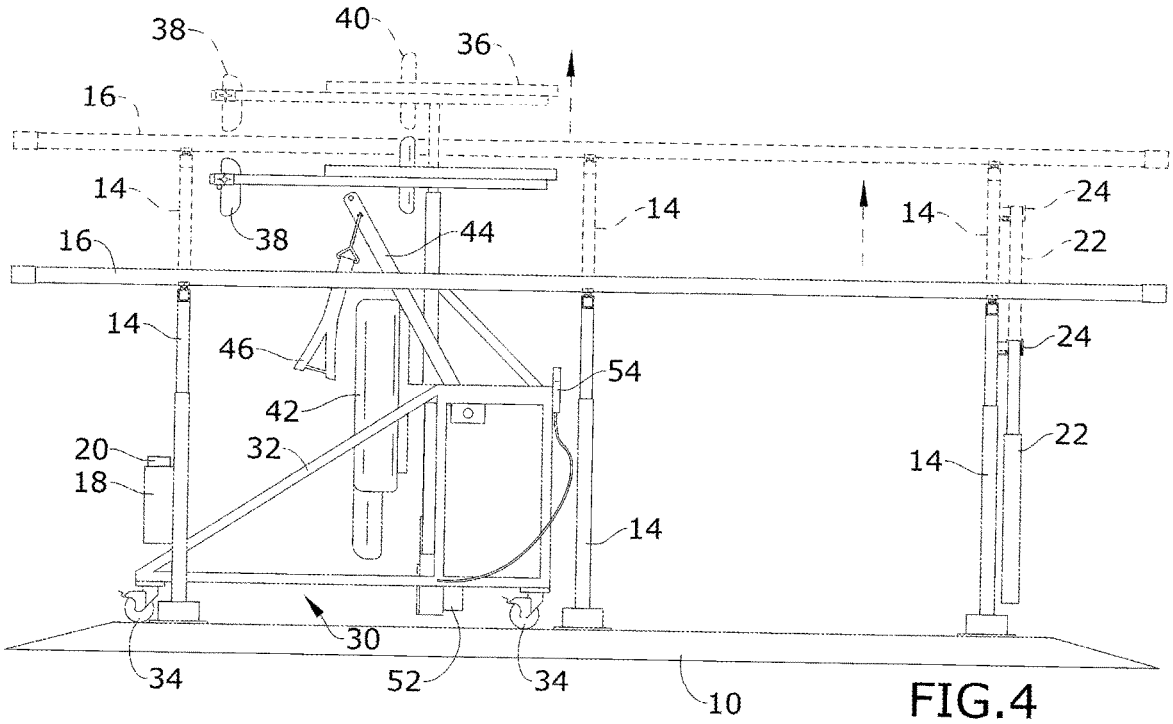
FIG. 4 conceptually illustrates a side view of a multi-therapeutic patient lift and parallel bars system in some embodiments, showing height adjustment of parallel bars and a tray.

By way of example, FIG. 4 conceptually illustrates a side view of the multi-therapeutic patient lift and parallel bars system, showing height adjustment of parallel bars 16 and the adjustable height tray 36. Specifically, height adjustment of parallel bars 16 occurs by operation of the bar adjustment motor 18 as controlled by the bar adjustment controller 20.

Now turning back to the front and rear perspective views of the multi-therapeutic patient lift and parallel bars system shown in FIGS. 1 and 2. In some embodiments, the end bar 22 latches onto the end bar hook 24 to prevent the lift-walker assembly 30 from moving past the end bar 22 during ambulation between the parallel bars 16. In some embodiments, the end bar 22 is unlatched from the end bar hook 24 to allow platform 10 ingress and egress between the parallel bars 16.

In some embodiments, the handrail 26 latches onto the handrail hook 28 to provide additional hand support to a patient using any of the standing frame, the step system, and the ramp within the parallel bars 16.

In some embodiments, the lift/walker assembly 30 houses all of the standing frame equipment to assist a patient to stand. In some embodiments, the lift/walker assembly 30 includes the frame 32, the locking casters 34, the adjustable height tray 36, the back pad 38, the chest pad 40, the knee pad 42, the lift arms 44, the lift strap 46, the lift adjustment motor 48, the tray height adjustment motor 50, the lift adjustment motor controller box 52, the tray height adjustment motor controller 54, and the kick plate with abduction board slot 56.

Figure 3:
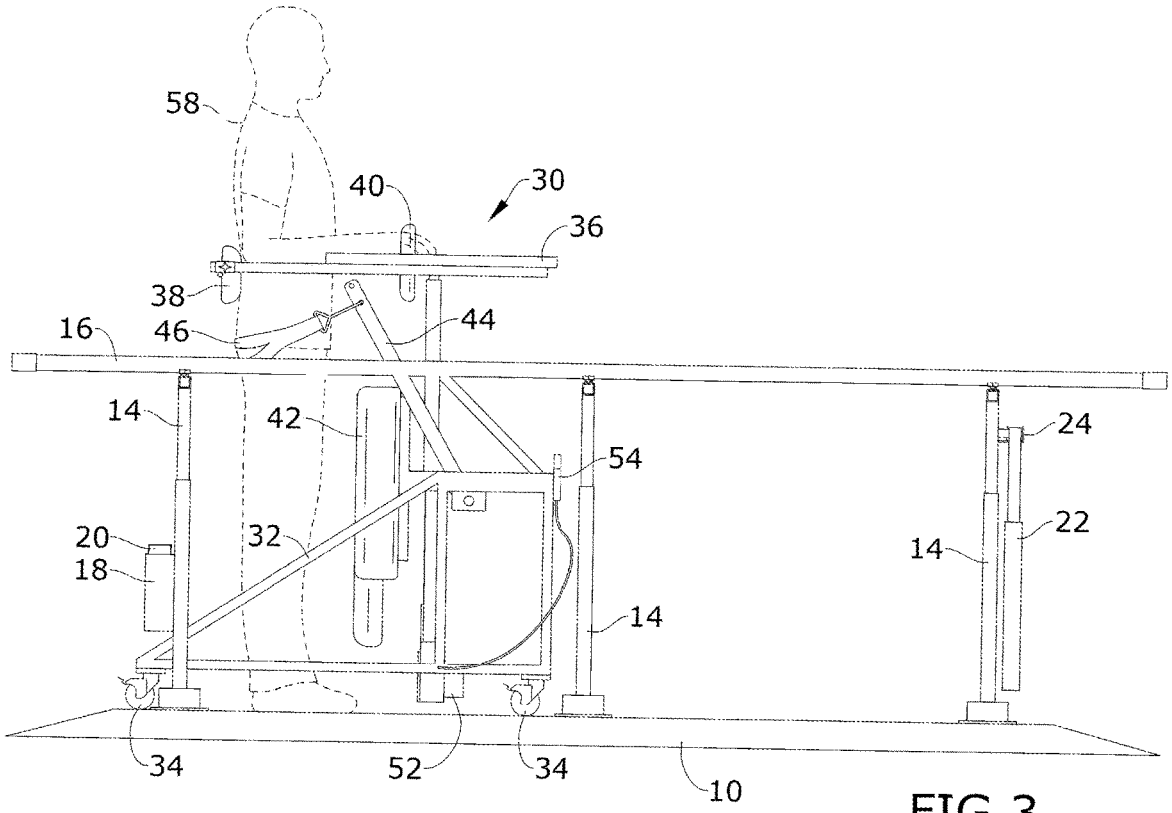
FIG. 3 conceptually illustrates a side view of a multi-therapeutic patient lift and parallel bars system in some embodiments, showing placement of a patient in a patient lift/walker.

By way of example, FIG. 3 conceptually illustrates a side view of the multi-therapeutic patient lift and parallel bars system, showing placement of a patient 58 in the patient lift/walker assembly 30 supported from behind by the back pad 38 and the lift strap 46.

Now turning back to the front and rear perspective views of the multi-therapeutic patient lift and parallel bars system shown in FIGS. 1 and 2. In some embodiments, the frame 32 provides a structural foundation for the lift/walker assembly 30. In some embodiments, the frame 32 of the lift/walker assembly 30 fits within a span width separating the parallel bars 16 to ensure that the lift/walker assembly moves linearly within the parallel bars 16 when a patient walks or moves forward. In some embodiments, the locking casters 34 are attached to a bottom of the frame 32.

In some embodiments, the locking casters 34 include wheels that can be locked in place (locked configuration) to ensure the lift/walker assembly 30 stays secure (locked) or is permitted to move (unlocked configuration). In some embodiments, the locking casters 34 lock wheels in the locked configuration to prevent movement of the lift/walker assembly 30 when not in use or when a patient is standing upright without forward or backward foot movement. Similarly, when the locking casters 34 are in an unlocked configuration, the wheels are free to move so that a patient standing in the standing frame can move the lift/walker assembly 30 along the platform 10 within the parallel bars 16.

In some embodiments, the adjustable height tray 36 is where a patient places elbows and performs projects. In some embodiments, the adjustable height tray 36 is motorized to go up and down. In some embodiments, the adjustable height tray 36 folds in two pieces for storage. In some embodiments, the adjustable height tray 36 collapses to allow reduced assistance for stronger patients standing in the standing frame. In some embodiments, the adjustable height tray 36 is removable to allow patients to stand without the tray 36 in the standing frame. In some embodiments, the adjustable height tray 36 includes a pair of parallel projection supports, one each to the left and the right of the patient in the standing frame with arms/elbows on the adjustable height tray 36.

Turning again to FIG. 4, the multi-therapeutic patient lift and parallel bars system demonstrates height adjustment adjustable height tray 36 along with the parallel bars 16. In this way, the patient 58, described above by reference to FIG. 3, can have the adjustable height tray 36 and parallel bars 16 set according to his or her height.

Once again turning back to the front and rear perspective views of the multi-therapeutic patient lift and parallel bars system shown in FIGS. 1 and 2. In some embodiments, the back pad 38 attaches to the adjustable height tray 36 at the posterior ends of the left and right parallel projection supports to maintain alignment of the patient and prevent excessive posterior leaning. In some embodiments, the pair of parallel project supports slide under the adjustable height tray 36 to move the back pad 38 closer to and farther from the adjustable height tray 36. In this way, the back pad 38 can be snugly adjusted to support the back torso of the patient while standing.

In some embodiments, the chest pad 40 attaches to the adjustable height tray 36 and keeps the torso of the patient in place. In some embodiments, the chest pad 40 is tucked under the adjustable height tray 36 when not in use.

In some embodiments, the knee pad 42 keeps the knees of the patient in place. In some embodiments, the knee pad 42 is used separately when the adjustable height tray 36 is removed or collapsed. In this way, patients who are able to tolerate it can attempt and/or engage in enhanced dynamic trunk activities.

In some embodiments, the lift arms 44 include a pair of parallel lift arms that are engaged when the lift adjustment motor 48 is activated, thereby raising or lowering the lift strap 46 that is in place to allow the patient to be moved into a standing position or lowered to a seated position. In some embodiments, the lift arms 44 include holes into which hooks for the lift strap 46 attach.

In some embodiments, the lift strap 46 includes a netting with opposite ends that each connect to a separate arm of the pairs of lift arms 44. In some embodiments, hooks are attached to the ends of the lift strap 46 netting. In some embodiments, the hooks are used to attach the lift strap 46 to the lift arms 44, hooking the ends of the lift strap 46 netting into the holes of the lift arms 44. In some embodiments, the netting of the lift strap 46 goes under the rear end of a patient to lift them up into a standing position as the lift arms 44 rise up by the power applied by the lift adjustment motor 48. In some embodiments, the lift strap 46 of the lift/walker assembly 30 locks into the parallel bars 16.

In some embodiments, the lift adjustment motor 48 moves the lift strap 46 up and down via the parallel lift arms 44. Accordingly, when a patient is secured by the lift strap 46 from under the patient's rear end, the patient can be lifted to a standing position, can be gently put down to a seated position after activities, or can be adjusted to rise or lower as needed during activities.

Returning to the example shown in FIG. 3, which demonstrates the patient 58 standing upright in the lift/walker assembly 30. Specifically, the lift strap 46 shown in this figure supports the patient 58 from under his or her rear end. When the lift arms 44 are activated by the lift adjustment motor 48 to move up, the lift strap 46 raises the patient 58 into standing position due to the attachment of the lift strap 46 hooks to the holes in the lift arms 44. Similarly, when the lift arms 44 are lowered, the lift strap 46 supports the patient 58 to smoothly and safely transition back into a seated position (say, in a wheelchair) from the prior standing position.

Again turning back to the front and rear perspective views of the multi-therapeutic patient lift and parallel bars system shown in FIGS. 1 and 2. In some embodiments, the tray height adjustment motor 50 is an electrically driven motor which, when powered, raises and lowers the adjustable height tray 36 to a height that is preferred by or suitable for a patient. For example, the tray height adjustment motor 50 may adjust the height of the adjustable height tray 36 to allow a particular patient of a particular size to optimally place elbows and/or forearms on the adjustable height tray 36, such as by bending the elbows of the patient at a right angle so the forearms and hands rest flat on the adjustable height tray 36. In this way, the patient can engage in hand activities on the adjustable height tray 36 while in a standing upright or may try to move forward, using the adjustable height tray 36 as hand and arm support.

In some embodiments, the lift adjustment motor controller box 52 is an electronic logic control device that directs the lift adjustment motor 48 to move the lift arms 44 up and down, and thereby move the lift strap 46 up and down. In some embodiments, the lift adjustment motor controller box 52 receives input commands from a remote control device operated by a user.

In some embodiments, the tray height adjustment motor controller 54 is an electronic logic control device that directs the tray height adjustment motor 50 to move the adjustable height tray 36 up and down. In some embodiments, the tray height adjustment motor controller 54 receives input commands from a remote control device operated by a user. In some embodiments, the tray height adjustment motor controller 54 directs the tray height adjustment motor 50 to move the posterior parallel projection supports away from and closer to the adjustable height tray 36 according to the input command received from the remote control device.

Parallel bars and tray height adjustment is shown again in FIG. 4. Specifically, height adjustment of parallel bars 16 occurs by operation of the bar adjustment motor 18 as controlled by the bar adjustment controller 20 while height adjustment of the adjustable height tray 36 occurs by operation of the tray height adjustment motor 50 as controlled by the tray height adjustment motor controller 54.

Now turning back to the front and rear perspective views of the multi-therapeutic patient lift and parallel bars system shown in FIGS. 1 and 2. In some embodiments, the kick plate with abduction board slot 56 acts as a foot guard to keep the feet of the patient in place and prevent the patient from sliding forward. In some embodiments, the kick plate with abduction board slot 56 is configured to allow an abduction board to fit through the abduction board slot. In some embodiments, the abduction board is a board that runs down the middle of the parallel bars to prevent the feet of the patient from crossing over during ambulation. In some embodiments, the abduction board runs through the abduction board slot in the kick plate 56. In some embodiments, the abduction board helps prevent a scissoring gait pattern. Thus, when an abduction board is used, the feet of the patient are prevented from tangling or scissoring as the patient moves forward.

In some embodiments, the multi-therapeutic patient lift and parallel bars system includes a remote control device to control movement of the parallel bars 16, the adjustable height tray 36, and the lift arms 44 and lift strap 46 for the patient lift of the lift/walker assembly 30. In some embodiments, the remote control device communicates wirelessly with logic controllers and controller boxes of the lift/walker assembly 30 to control motors. In some embodiments, the remote control device is attached to a long wound cord/cable that stays connected to the multi-therapeutic patient lift and parallel bars system and provides remote data communication between the remote control device and the logic controllers and controller boxes of the multi-therapeutic patient lift and parallel bars system. In some embodiments, the remote control device also controls automation of the collapsible ramp and the step system by way of the associated electronic motors.

In some embodiments, the multi-therapeutic patient lift and parallel bars system includes a relay box for the wired communication of the remote control device. In some embodiments, the relay box relays control commands, operation commands, and functions input by a user of the remote control device to the associated logic controllers and controller boxes and their corresponding electronic motors, with all possible wiring and transformers included.

In some embodiments, the multi-therapeutic patient lift and parallel bars system includes a step system. In some embodiments, the step system is a collapsible step system that is built into the storage hatch of the platform. The collapsible step system of some embodiments is capable of making a single step for aerobic use or practice going up with a walker. In some embodiments, the collapsible step system includes a series of steps with a platform at the end. In this way, the collapsible step system can simulate practice in the home and community environment. In some embodiments, the step system is a movable set of steps that fits with the span between the parallel bars.

Figure 5:
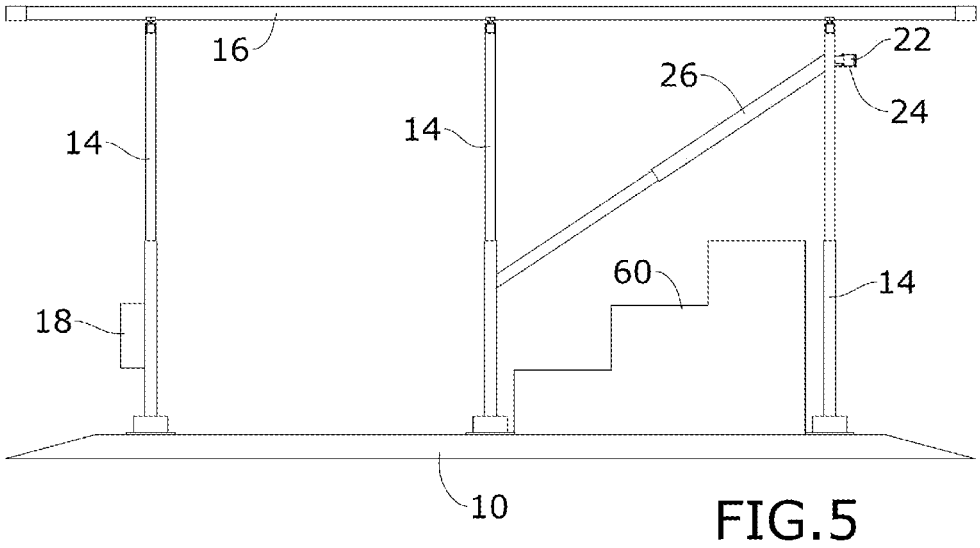
FIG. 5 conceptually illustrates a side view of a multi-therapeutic patient lift and parallel bars system in some embodiments, showing parallel bars and stairs in place.

By way of example, FIG. 5 conceptually illustrates a side view of the multi-therapeutic patient lift and parallel bars system with a step system 60 in position along the platform 10 between the parallel bars 16. In this figure, the step system 60 is shown with a series of three steps which the patient 58 can step onto while holding the handrail 26, which is latched into the handrail hook 28 (in a diagonal configuration based on the height of the parallel bars 16, with another handrail 26 latched to another handrail hook 28 on the other bar of the parallel bars 16). In addition, the end bar 22 is latched to the end bar hook 24 in a lateral configuration (perpendicular to the parallel bar uprights 14) to prevent ambulation of the patient 58 beyond the top step of the step system 60.

In some embodiments, the multi-therapeutic patient lift and parallel bars system includes a ramp system. In some embodiments, the ramp system raises the entire parallel bars apparatus at one end by an electric motor or by a manual crank system. Raising one end of the parallel bars apparatus simulates patient ambulation, climbing up and down ramps, and simulates the community setting. In some embodiments, there are two ramps. There is the standard ramp and another ramp, which is more or less a smaller, starter ramp for someone to walk up and down, with parallel bars at their side. The smaller ramp is built into the floor, with the steps and platform. This is a ramp with a height of about one-two steps. In some embodiments of a remote motorized system, the smaller ramp works by popping out of the floor. In some embodiments, a user simply presses a button and the ramp would come together, instead of the steps or platform.

Figure 6:
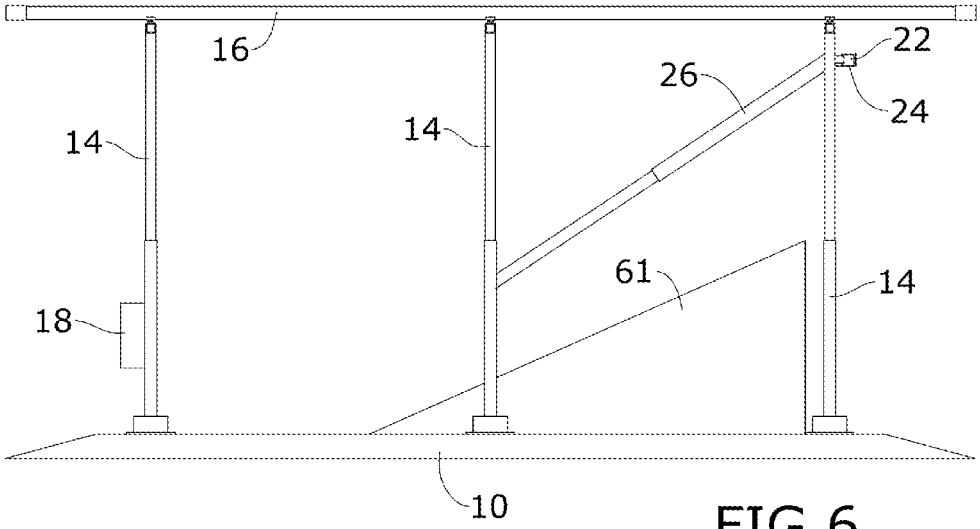
FIG. 6 conceptually illustrates a side view of a multi-therapeutic patient lift and parallel bars system in some embodiments, showing parallel bars raised and a ramp in place.

By way of example, FIG. 6 conceptually illustrates a side view of the multi-therapeutic patient lift and parallel bars system with a ramp system 61 in position along the platform 10 between the parallel bars 16. In this figure, the ramp system 61 is shown with an incline that allows the patient 58 to step gradually up and down the ramp 61. As described above by reference to FIG. 5, the handrail 26 is configured diagonally to provide hand support to the patient 58 as the patient 58 moves up and down the ramp 61. The diagonal configuration of the handrail 26 occurs by latching the handrail 26 to the handrail hook 28 and by height adjustment of the parallel bars 16, as noted above (with another handrail 26 latched to another handrail hook 28 on the other bar of the parallel bars 16). In addition, the end bar 22 is latched to the end bar hook 24 in a lateral configuration (perpendicular to the parallel bar uprights 14) to prevent ambulation of the patient 58 beyond the top step of the step system 58.

In some embodiments, additional handrails are deployed in the multi-therapeutic patient lift and parallel bars system to support the hands of a patient 58 going up and down the steps of the step system 60 (either or both of the movable step system and the collapsible step system) or the incline of the ramp system 61.

In some embodiments, the abduction board 62 is a board that runs down the middle of the parallel bars 16 to prevent the feet of the patient 58 from crossing over during ambulation. In some embodiments, the abduction board 62 runs through a slot in the kick plate 56. In some embodiments, the abduction board 62 helps prevent a scissoring gait pattern by the patient 58. In some other embodiments of the multi-therapeutic patient lift and parallel bars system, described below by reference to FIGS. 8-13, the abduction board 62 is not built into the kick plate of the standing frame. In some embodiments, the abduction board 62 is used with the parallel bars flat and no other devices opened or used, including the standing frame portion.

Figure 7:
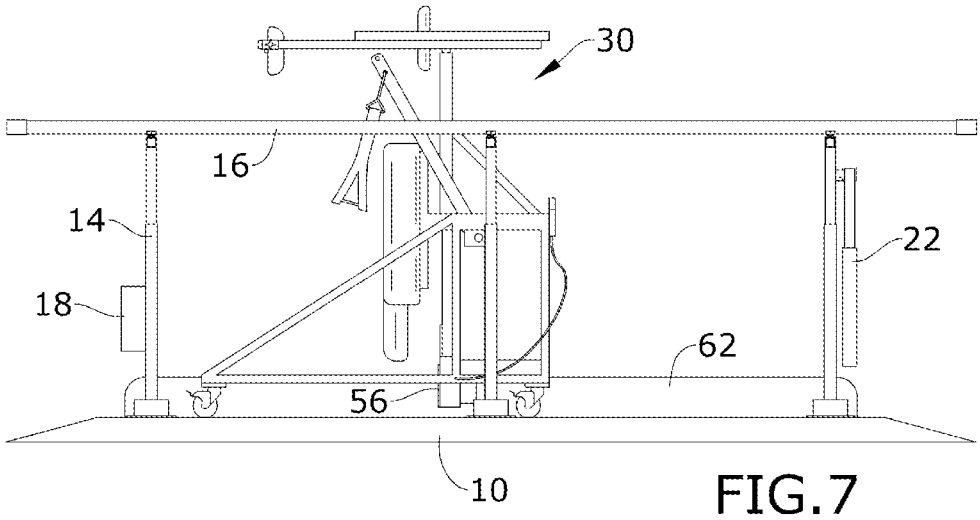
FIG. 7 conceptually illustrates a side view of a multi-therapeutic patient lift and parallel bars system in some embodiments, showing placement of an abduction board.

By way of example, FIG. 7 conceptually illustrates a side view of the multi-therapeutic patient lift and parallel bars system, showing placement of an abduction board 62. In this figure, the lift/walker assembly 30 is shown over the top of the abduction board 62 which runs along the platform 10 in a parallel configuration with respect to the parallel bars 16, and sliding through the abduction board slot in the kick plate 56, thereby allowing the patient 58 to move the lift/walker assembly 30 along the platform 10 between the parallel bars 16.

The examples described above by reference to FIGS. 1-7 demonstrate at least a first embodiment of the multi-therapeutic patient lift and parallel bars system, as well as several additional therapy equipment items and devices used in conjunction with the multi-therapeutic patient lift and parallel bars system (including at least the step system and the ramp system). Several other examples of other embodiments of the multi-therapeutic patient lift and parallel bars system are described below by reference to FIGS. 8-13.

Figure 8:
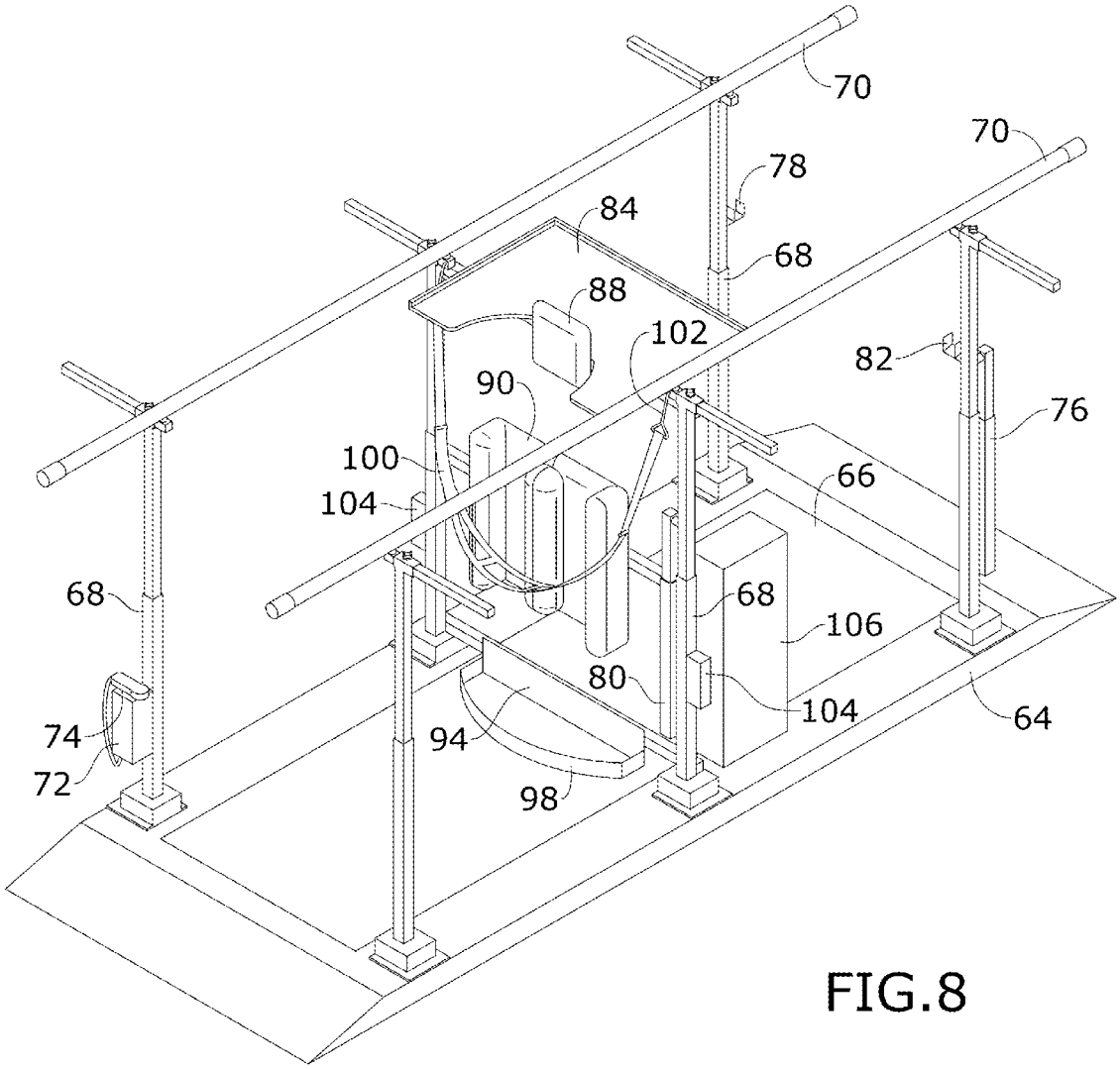
FIG. 8 conceptually illustrates a front perspective view of a second embodiment of a multi-therapeutic patient lift and parallel bars system.
Figure 9:
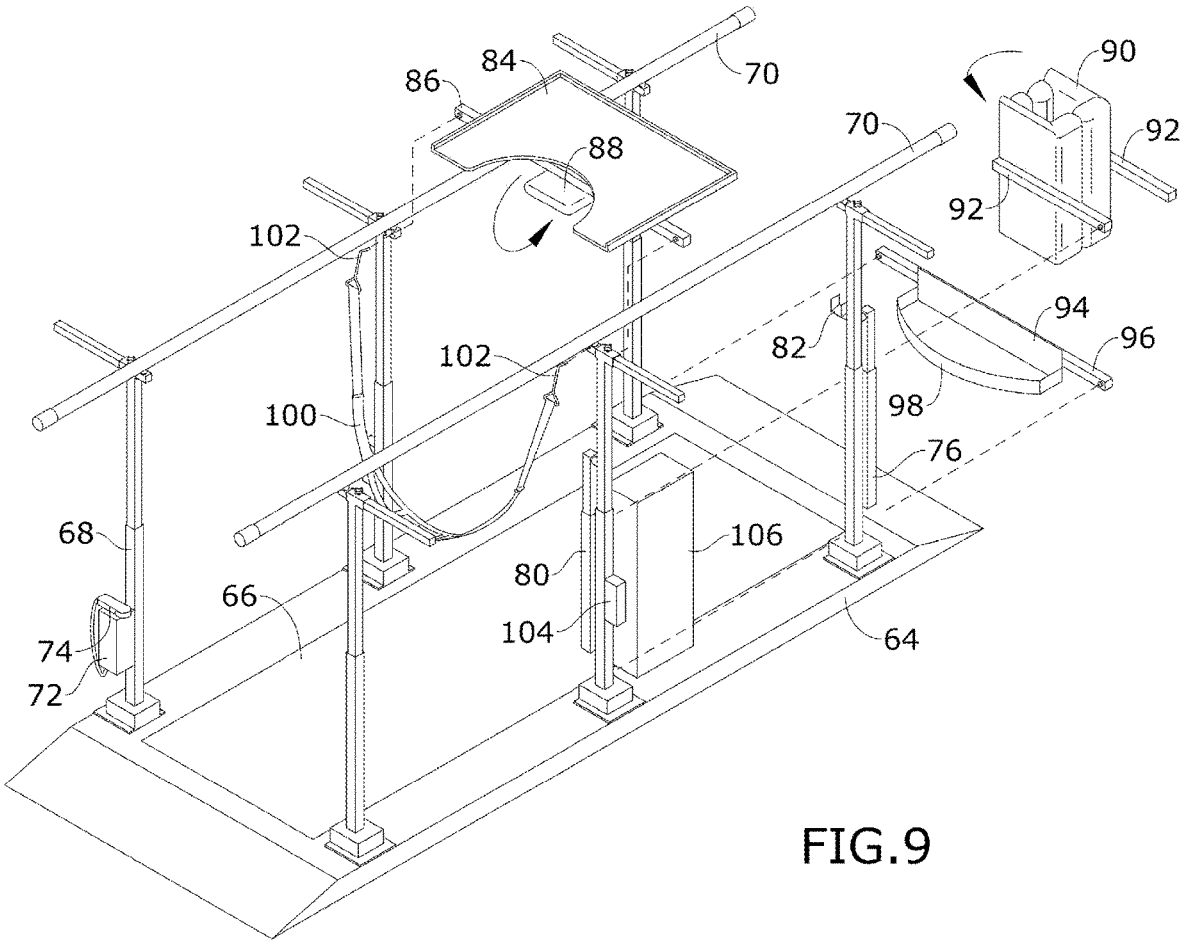
FIG. 9 conceptually illustrates an exploded view of the second embodiment of the multi-therapeutic patient lift and parallel bars system, showing removal of standing frame components and folding of pads.

By way of example, FIG. 8 conceptually illustrates a front perspective view of a second embodiment of a multi-therapeutic patient lift and parallel bars system and FIG. 9 conceptually illustrates an exploded view of the second embodiment of the multi-therapeutic patient lift and parallel bars system. Starting with FIG. 8, the second embodiment of the multi-therapeutic patient lift and parallel bars system shown in this figure includes a platform 64, a storage hatch 66, several parallel bar uprights 68, a pair of parallel bars 70, a bar adjustment motor 72, a bar adjustment controller 74, an end bar 76, an end bar hook 78, a handrail 80, a handrail hook 82, a removable tray 84, a chest pad 88, a removable knee pad 90, a removable foot plate 94, a posterior foot strap 98, a patient lift sling 100, sling hooks 102, sling motors 104, and a standing frame component storage box 106. Additionally, as shown in FIG. 9, the second embodiment of the multi-therapeutic patient lift and parallel bars system further includes a tray attachment bar 86, a knee pad attachment bar 92, and a foot plate attachment bar 96.

While there are many similar components (or same components) between the first and second embodiments of the multi-therapeutic patient lift and parallel bars system, there are some notable differences between the first and second embodiments of the multi-therapeutic patient lift and parallel bars system. Similar (or same) components between the first and second embodiments of the multi-therapeutic patient lift and parallel bars system include, without limitation, the platform 64 (the platform 10), the storage hatch 66 (the storage hatch 12), the several parallel bar uprights 68 (parallel bar uprights 14), the pair of parallel bars 70 (parallel bars 16), the bar adjustment motor 72 (bar adjustment motor 18), the bar adjustment controller 74 (bar adjustment controller 20), the end bar 76 (end bar 22), the end bar hook 78 (end bar hook 24), the handrail 80 (handrail 26), the handrail hook 82 (handrail hook 28), the removable tray 84 (similar to the adjustable height tray 36), and the chest pad 88 (chest pad 40).

However, unlike the first embodiment of the multi-therapeutic patient lift and parallel bars system described above by reference to FIGS. 1-7, the second embodiment of the multi-therapeutic patient lift and parallel bars system does not include a lift-walker assembly 30. Instead, the second embodiment of the multi-therapeutic patient lift and parallel bars system provides a patient standing frame from a plurality of standing frame components, including the tray attachment bar 86 (in connection with the removable tray 84 and chest pad 88), the removable knee pad 90 and the knee pad attachment bar 92, the removable foot plate 94 and the foot plate attachment bar 96, the posterior foot strap 98, the patient lift sling 100, the sling hooks 102, and the sling motors 104. In addition to the plurality of components of the patient standing frame, the second embodiment of the multi-therapeutic patient lift and parallel bars system includes the standing frame component storage box 106 in which to store the plurality of standing frame components.

The component differences are further illustrated in FIG. 9, in which the exploded view of the second embodiment of the multi-therapeutic patient lift and parallel bars system demonstrates removal of standing frame components and folding of removable pads. As shown in this figure, the removable tray 84, the tray attachment bar 86, and the chest pad 88 are removed from the parallel bars 70 by releasing the sling hooks 102 of the patient lift sling 100 from holes in the tray attachment bar 86 and sliding the removable tray 84 and tray attachment bar 86 out from the parallel bar uprights 68 and away from the pair of parallel bars 70. Additionally, the chest pad 88 is turned to tuck under the tray attachment bar 86 and removable tray 84. The patient lift sling 100 and sling hooks are also removed in this action. The removable knee pad 90 and the knee pad attachment bar 92 are detached from the parallel bar uprights 68 and moved out from within the pair of parallel bars 70. The knee pad attachment bar 92 includes a "break" that allows the knee pad attachment bar 92 to fold into separate half bars while also folding the removable knee pad 90. Finally, the foot plate attachment bar 96 is detached from the parallel bar uprights 68 and removed away from the pair of parallel bars 70. As the removable foot plate 94 is attached to the foot plate attachment bar 96 and the posterior foot strap 98 is attached to the removable foot plate 94, both the removable foot plate 94 and the posterior foot strap 98 are removed when the foot plate attachment bar 96 is detached and removed. After detachment, removable, and folding/tucking, the plurality of standing frame components can be stored in the standing frame component storage box 106, which is attached to the side of the multi-therapeutic patient lift and parallel bars system shown in this figures.

Figure 10:
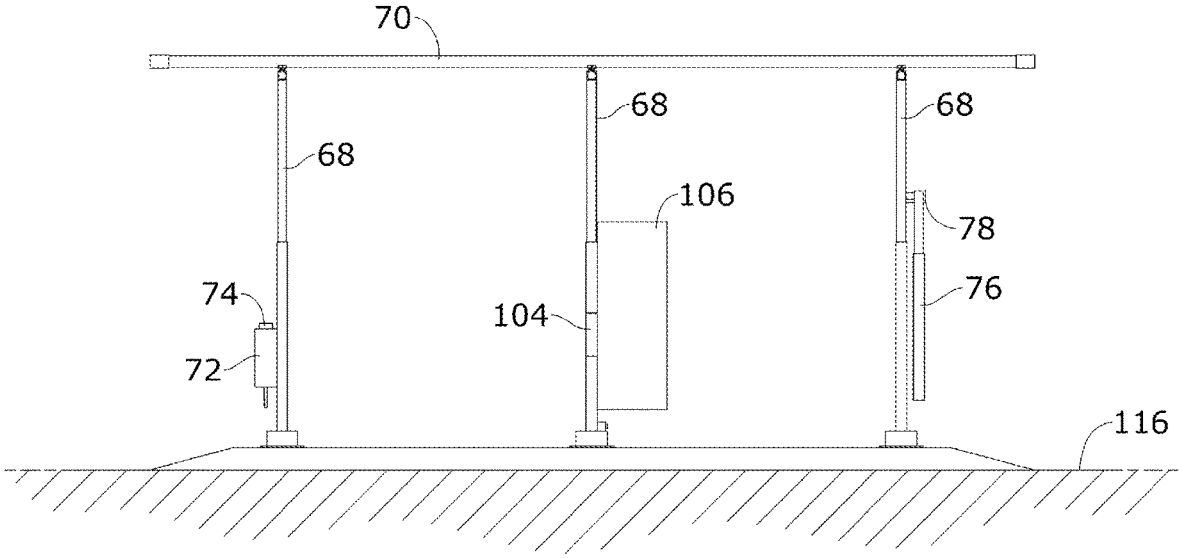
FIG. 10 conceptually illustrates a side view of the second embodiment of the multi-therapeutic patient lift and parallel bars system, with standing frame components removed.

By way of example, FIG. 10 conceptually illustrates a side view of the second embodiment of the multi-therapeutic patient lift and parallel bars system, with standing frame components removed. As shown in this figure, the platform 64, the parallel bar uprights 68, the pair of parallel bars 70, the bar adjustment motor 72, the bar adjustment controller 74, the end bar 76, the sling motors 104, and the standing frame component storage box 106 remain set on the therapy gym floor 116 after the standing frame components have been removed from the second embodiment of the multi-therapeutic patient lift and parallel bars system.

When the standing frame components are removed from the second embodiment of the multi-therapeutic patient lift and parallel bars system, it is possible for a patient to use the second embodiment of the multi-therapeutic patient lift and parallel bars system in other therapeutic ways. For instance, the second embodiment of the multi-therapeutic patient lift and parallel bars system can be used in a ramp configuration by raising the platform to allow the patient to engage in walking activities up or down the ramp. Like the step system 60 of the first embodiment of the multi-therapeutic patient lift and parallel bars system described above by reference to FIG. 5, a step system can be deployed and utilized in the second embodiment of the multi-therapeutic patient lift and parallel bars system, where a step system configuration engages a patient by utilizing the step system within the pair of parallel bars 70 when the standing frame components are removed, thereby allowing the patient to engage in step motor activities up or down the steps. Also, in both the first and second embodiments of the multi-therapeutic patient lift and parallel bars system, a patient can engage in single step therapy exercises or activities.

Figure 11:
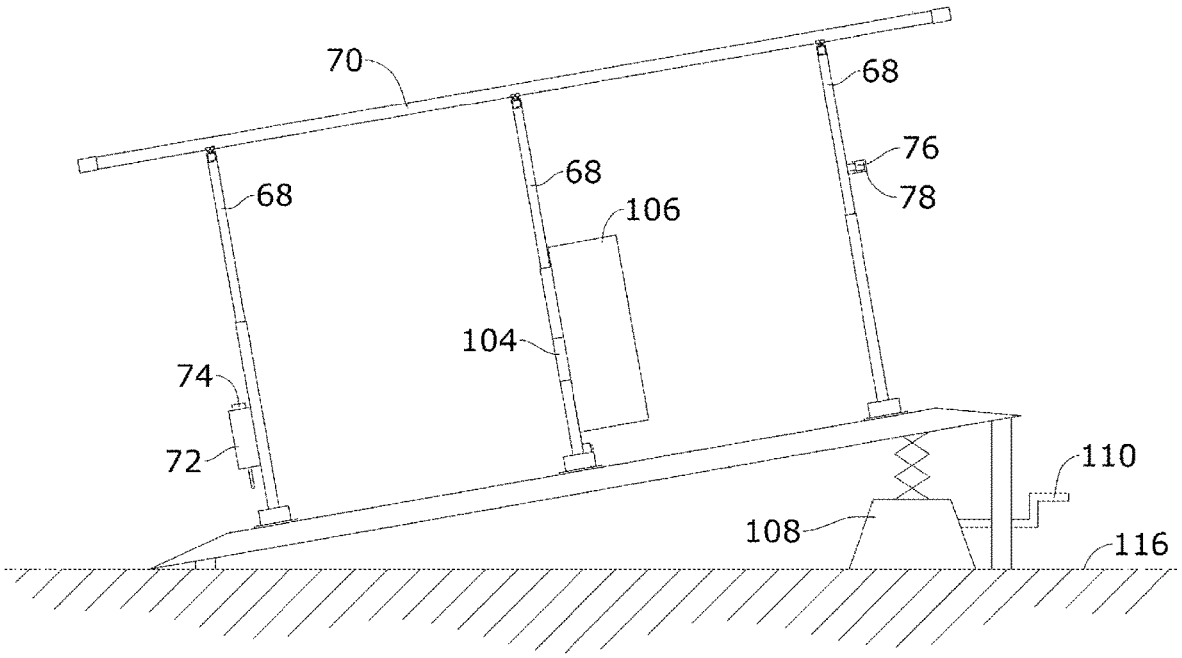
FIG. 11 conceptually illustrates a side view of the second embodiment of the multi-therapeutic patient lift and parallel bars system, showing raising of the platform, with end bar raised.

By way of example, FIG. 11 conceptually illustrates a side view of the second embodiment of the multi-therapeutic patient lift and parallel bars system in a ramp configuration. Specifically, the ramp configuration of the second embodiment of the multi-therapeutic patient lift and parallel bars system is possible by raising the platform 64. As shown in this figure, the platform 64 is raised by a lift jack 108 that is positioned under the platform 64 (between the platform 64 and the therapy gym floor 116) and rises up with turning (or cranking) of a jack handle 110. In addition, the end bar 76 is shown in a lateral configuration (perpendicular to the parallel bar uprights 68), being attached to the end bar hook 78 of the opposing parallel bar upright 68.

Figure 12:
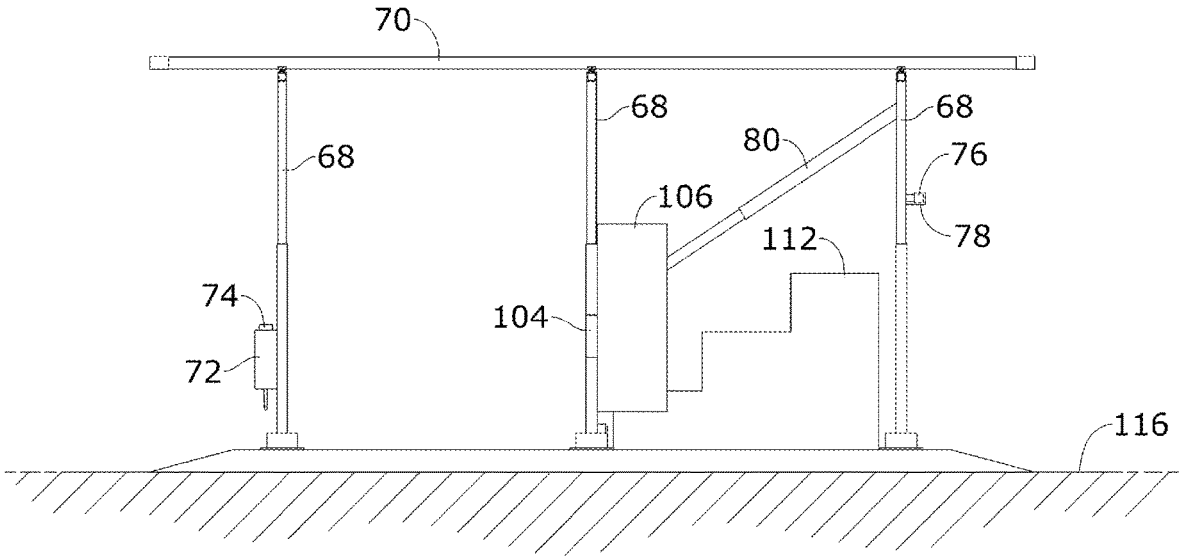
FIG. 12 conceptually illustrates a side view of the second embodiment of the multi-therapeutic patient lift and parallel bars system, showing stairs and handrail raised.
Figure 13:
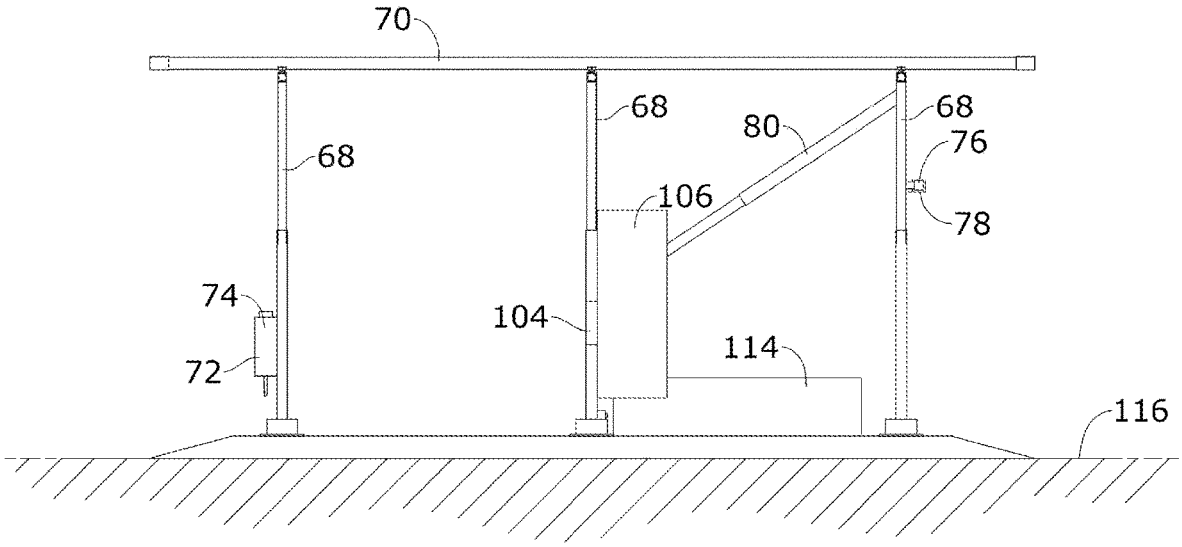
FIG. 13 conceptually illustrates a side view of the second embodiment of the multi-therapeutic patient lift and parallel bars system, showing a single step platform.

Now turning to another example, FIG. 12 conceptually illustrates a side view of the second embodiment of the multi-therapeutic patient lift and parallel bars system, showing how a set of stairs 112 of a step system can be deployed and utilized to engage a patient by utilizing the stairs 112 within the pair of parallel bars 70 when the standing frame components are removed. This example also demonstrates the handrail 80 in a diagonal configuration in connection with the handrail hook 82. The handrail 80 provides additional hand support to the patient walking up the stairs 112 until the patient can utilize the pair of parallel bars 70 for support during the stair climbing activities. In addition, the end bar 76 is shown in a lateral configuration (perpendicular to the parallel bar uprights 68), being attached to the end bar hook 78 of the opposing parallel bar upright 68.

As noted above, both the first and second embodiments of the multi-therapeutic patient lift and parallel bars system support a single step platform in which a patient can engage in single step therapy exercises or activities. By way of example, FIG. 13 conceptually illustrates a side view of the multi-therapeutic patient lift and parallel bars system showing the single step platform 114, with the handrail 80 positioned diagonally for additional patient hand support, and the end bar 76 positioned laterally (perpendicular to the parallel bar uprights 68) in connection with the end bar hook 78.

The multi-therapeutic patient lift and parallel bars system of the present disclosure generally works similar to how typical conventional parallel bars would work in a therapy environment. For instance, a patient goes into the parallel bars and performs activities, such as walking, standing, balancing, and/or other exercises. The parallel bars move up and down, closer or farther, to fit a variety of patient sizes.

With respect to at least the first and second embodiments of the multi-therapeutic patient lift and parallel bars system described in this specification, when a standing frame is required, the standing frame components can be easily assembled and put into place. When not needed, the standing frame components can be disassembled, removed, and put into places that are available in the therapy gym or stored in the standing frame component storage at the side. By storing away or collapsing at the side, the standing frame and the lift/walker assembly do not obstruct the parallel bars system when not in use. This frees up the parallel bars apparatus to be used separately or in conjunction with other therapy equipment, such as a step system, a single step platform, or a ramp system.

removable tray 84 and tray attachment bar 86

In some embodiments, the standing frame portion can be collapsed to the side of the parallel bars apparatus when not in use. In some embodiments, when needed, the collapsed standing frame (lift/walk assembly) moves forward on the outside of the parallel bars, then swings over to the other side of the parallel bars and latches onto a support pillar or parallel bar upright (or otherwise secures into place) on the other side to fully lock into place. The kick plate is already in place, along with the knee pad, which can be used solely/separately from the adjustable height tray. The adjustable height tray of the first embodiment and the removable tray/tray attachment bar of the second embodiment is folded down in the back and has the chest pad underneath it that is stored away (or tucked underneath), when in a non-deployed configuration of the multi-therapeutic patient lift and parallel bars system or when using the knee pad in the standing frame by a patient without the elbow support provided by the adjustable height tray and/or removable tray. When deployed, however, the adjustable height tray or removable tray of some embodiments of the multi-therapeutic patient lift and parallel bars system unfolds from behind the knee pad, and slides and locks in place via slide rails. Once the adjustable height tray or removable tray is locked into place, the chest pad (which is stored underneath the adjustable height tray or removable tray) flips up and locks into place. After these set up actions, the standing frame portion of the multi-therapeutic patient lift and parallel bars system is in place and is ready for use.

Additionally, in the second embodiment of the multi-therapeutic patient lift and parallel bars system, the lift strap apparatus is in place with parallel supports that are attached to the entire locked-in multi-therapeutic patient lift and parallel bars system, and is ready to be lowered to allow the netting that attaches to the lateral supports (of the parallel bar uprights) to be put in place. In the first embodiments of the multi-therapeutic patient lift and parallel bars system, a remote control with buttons can be used to lift the adjustable height tray, once in place, to go up and down and thereby accommodate patients of different heights. The remote control, in both the first and second embodiments of the multi-therapeutic patient lift and parallel bars system, includes buttons that lift up and lower down the patient in the lift strap by way of the lift bars 44 and lift adjustment motor in the first embodiment and by way of the sling motors 104 in the second embodiment of the multi-therapeutic patient lift and parallel bars system.

Further aspects of the multi-therapeutic patient lift and parallel bars system include the following. In some embodiments, one end of the parallel bars is available for another patient to use to assist with standing and other therapy activities. In some embodiments, there is a safety feature that limits how close the parallel bars move inward when a patient is using the lift/walker assembly (in the first embodiment) and the standing frame (in the second embodiment). This constraint on the minimum width of the span between the parallel bars is set to ensure that the patient is not compressed while within the standing frame portion or the lift/walker assembly. When the standing frame is not in place, it is neatly folded into the outer-side of the parallel bars or the standing frame components are disassembled and put away into the standing frame component storage. Nevertheless, patients are able to continue to utilize the parallel bars system without the lift/walker assembly and/or standing frame portion. Thus, when the standing frame is collapsed to the side or the lift/walker assembly is removed from the platform, the parallel bars are able to move closer together to meet the patient's physical therapy needs, and steps or ramps can be utilized as needed or desired.

In some embodiments, the parallel bars move up and down and side to side (left and right) to accommodate patients of different size, and provide optimum hand placement for gait and standing activities inside the parallel bars. The lift/walker assembly ensures that the adjustable height tray can move up and down via electric motor to accommodate patients of different sizes and heights. Similarly, the standing frame portion, when properly attached, ensures that the removable tray, which is attached to the supports of the parallel bar uprights by the removable tray bar, moves up and down in connection with upward and downward movement of the parallel bars via bar adjustment motor to accommodate patients of different sizes and heights. There is also the lift strap in both the standing frame and lift/walker assembly that lifts the patient from a chair or wheelchair to standing position. The lift strap is a mechanism of the multi-therapeutic patient lift and parallel bars system that is also powered by an electric motor(s), specifically, the sling motors in the second embodiment of the multi-therapeutic patient lift and parallel bars system and the lift adjustment motor in the first embodiment of the multi-therapeutic patient lift and parallel bars system. The patient would therefore use the parallel bars, in the usual way or in typical fashion to ambulate inside, or use one end of the parallel bars for the standing frame.

In some embodiments, the multi-therapeutic patient lift and parallel bars system has a default setting to ensure that the parallel bars will not get too close (so as to compress) to the patient in the standing frame when in use. In some embodiments, the multi-therapeutic patient lift and parallel bars system includes a "break" in the bar that allows full utilization of the bars. The standing frame will be in place, but the available parallel bars across from the standing frame may be used for another patient's rehab exercises; although, this would be more expensive to produce as more motors and adjustments would have to be made. In some embodiments of the multi-therapeutic patient lift and parallel bars system, all of the various sub-systems are able to be controlled via remote control.

In some embodiments, the step system is built into the floor of the parallel bars (or storage hatch). In some embodiments, there is a sliding system, like a garage door, that slides to produce one step/platform or a series of steps. In some embodiments, underneath this floor (storage hatch) is a sub-floor similar to, if not the same as the step or top portion of the therapy gym floor. In some embodiments, there is a series of tracks and hinges to make this possible and a motor system that is computer controlled (logic motor controllers) will stop first at a single aerobic step/platform, such as the single step platform described above by reference to FIG. 13. The second stage will turn into a series of three steps with the third being the top platform, such as the step system described above by reference to FIG. 5 or the set of stairs described above by reference to FIG. 12. This entire system will completely fold into the sub-floor or storage hatch. In some embodiments, the multi-therapeutic patient lift and parallel bars system includes additional supports for the hands that are integrated into the support pillars.

In some embodiments, the ramp system includes an electric motor/hydraulic system, or manual crank system that attaches to the bottom of one end of the parallel bars that will raise one end of the parallel bars system, to different heights, to simulate going up and down a ramp in the community. In some embodiments, there is a grade system, and/or level of height in inches, to determine the height. Some embodiments of the multi-therapeutic patient lift and parallel bars system include a safety stop with a limit that constrains how high the parallel bar system can go on one end. Examples of the ramp system are described above by reference to FIG. 6 (i.e., electric motor/hydraulic ramp system) and FIG. 11 (i.e., manual crank ramp system).

To make the multi-therapeutic patient lift and parallel bars system of the present disclosure, a person may use a strong parallel bars system, like any conventional parallel bars system available today, and then modify it. The person may strengthen all the support pillars and attachments, and then modify two of the support pillars at one end even further so it would be able to accommodate the lift/walker assembly and/or a standing frame. The standing frame has all the necessary parts neatly folded away to the side of the parallel bar system or stowed away in the standing frame component storage that includes all of the standing frame components and folded pads. The parts for the standing frame and/or the lift/walker assembly are all commercially available, like any standing frame has today, except they will be put into a collapsible system and folded away with a series of hinges and tracks that will collapse all of the parts. A company may create a series of tracks and hinges to accommodate all of the parts to collapse it out of the way.

In some embodiments, additional attachments for both parallel bars and the standing frame are able to use with the multi-therapeutic patient lift and parallel bars system. Options for the parallel bars, which already exist are: step ladder, electrically driven vs. manual bars adjustment of the parallel bars, balance beam, parallel bar glides, digital display with memory, abduction board (which is standard with a number of parallel bars), foot placement ladder, two pairs of hand rails with one for the pediatric patient. There could also be a bariatric equipped parallel bars or wall mount equipment. Options for the standing frame portion include: height and multiple foot adjustable system(s), multiple knee adjustment system(s), and/or hook and loop fastener foot adjustment system(s). Materials to make the multi-therapeutic patient lift and parallel bars system can include metal, wood, or plastic type materials, for the parts of the track system for the steps. The track system may also have small wheels, and locks, to "save" the position. This may be computer controlled, and built into the sub-floor, when not in use.

In some embodiments, the manual crank ramp system attaches to the bottom of one end of the parallel bars that will raise one end of the parallel bars system to different height to simulate going up and down a ramp in the community. In some embodiments, the ramp system includes a grade system that provides a level of height in inches to determine the height. In some embodiments, the safety stop constrains the height to which the parallel bars rise. Again, metal parts, motors and/or manual crank gearing system will typically be used.

As a single, encompassing machine or apparatus, this entire multi-therapeutic patient lift and parallel bars system could be built by man and computer. Parts of the machine or apparatus will most likely be built separately and attached later. Possible development of an assembly line could be feasible. Metal would be used for all the hand rails of the parallel bar system.

The lift/walker assembly (and collapsed standing frame portion) could be collapsed in different arrangements. The lift/walker assembly could be put on either end, or either side, of the parallel bars. The options listed above are options on several available standing frames and parallel bars systems today.

To use the multi-therapeutic patient lift and parallel bars system of the present disclosure, a person would simply use the parallel bars as any other parallel bar system. The patient would walk in and ambulate, perform balance, or exercise as any person would in any other parallel bar system. The only difference is if the standing frame is needed to help stand a patient, who is unable to on his own, will be put into place. The entire standing frame section is neatly folded to the outer-side of the parallel bars. This standing frame, will slide forward, and unfold into a complete standing frame at one end of the parallel bars leaving the opposite end of the parallel bars open for regular use of the parallel bars.

To use the ramp section of the parallel bars, the therapist will need to put the bar in place that will safely close the end of the parallel bars system that is elevated. This would help keep the patient from falling off the elevated end-for safety when they go to the top. The patient would use their hands for stability to hold onto as they ascend and descent the ramp. To use the system the therapist will simply press a button to activate an electric motor. This will raise one end of the parallel bar platform to the desired height. You could possibly use a manual crank system, with gears; although, this would be more cumbersome and less desirable as this is a premium device.

To use the step system, you press a button to the step/platform. The top layer of the floor, with track system, will automatically fold the floor (like a garage door) to produce one step, and also a platform. This will allow patients to perform stepping up on one step and down. This will be the same platform that will be at the top of the three steps when the system is put into a step series. The platform/step will be big enough for a patient to step up on and turn around to use a walker, cane, etc. You raise the parallel bars to the appropriate height for the patient for the transition to the platform. To reverse or collapse this one simply presses a button that will collapse the step/platform into the floor. The step is now out of the way and the floor of the parallel bars is now flat and the parallel bars are able to be used in a regular manor.

To use the step series the therapist will press a button that enables the motors to turn this contraption into three steps with the top being the platform. You will need to use the safety front cross bar which is located at the top. The safety bar can be locked into place to help keep the patient from falling off the end of the platform once they are at the top. There will be a set of sub parallel bars that will come from the supports and will create a set of hand rails for the patient to use as they ascend and descent the steps. The support pillars of the parallel bars will be collapsible. They will collapse into the support pillars when not in use for the step system. Press a button again to have the step system fold into the floor and disappear. Fold the collapsible top cross bar back into place into the pillars where it will disappear and is now out of the way when not in use.

In this specification, the terms "controller", "logic control", or "software" are meant to include applications, programs, embedded programs, and/or logic control instructions stored in magnetic storage, which can be read into memory for processing by a processor. In some embodiments, the controller, logic control, or software, when installed to operate on one or more electronic systems or automated control devices, define one or more specific machine implementations that execute and perform the operations of the controller, the logic control, or the software. In particular, the electric motor operations described above may be implemented as controlled logic routines, logic control programs, or software processes that are specified as a set of instructions recorded on a computer readable storage medium (also referred to as a non-transitory computer readable medium). When these instructions are executed by one or more processing unit(s) or main control unit(s), they cause the processing unit(s) or main control unit(s) to perform the actions indicated in the instructions. Examples of computer readable media include, but are not limited to, CD-ROMs, flash drives, RAM chips, hard drives, EPROMs, EEPROMs, etc. The computer readable media does not include carrier waves and electronic signals passing wirelessly or over wired connections.

Figure 14:
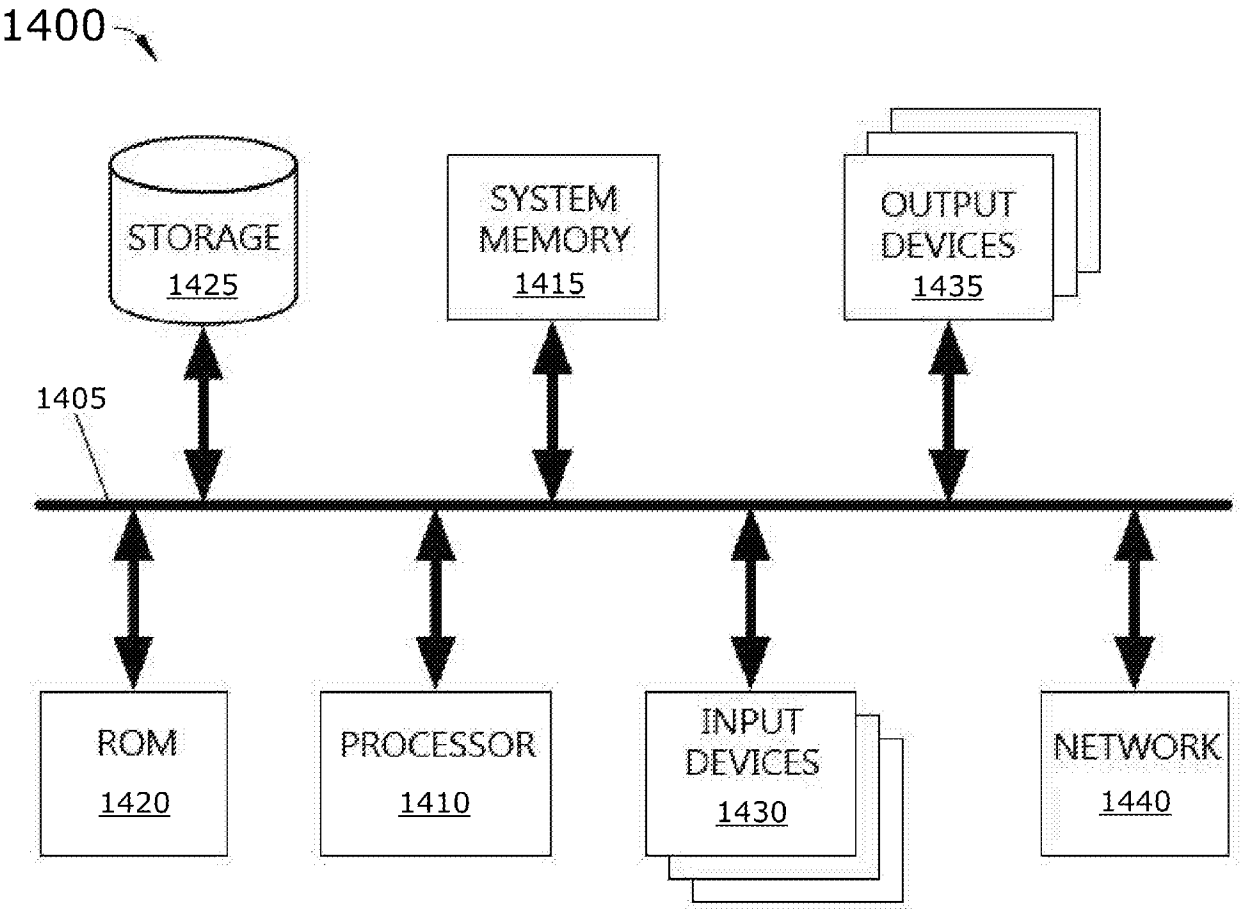
FIG. 14 illustrates an electronic system with which some aspects of some embodiments of the multi-therapeutic patient lift and parallel bars system are implemented.

FIG. 14 illustrates an electronic system 1400. The electronic system 1400 may be any computing device, main control unit, or any other sort of electronic device. Such an electronic system includes various types of computer readable media and interfaces for various other types of computer readable media. Electronic system 1400 includes a bus 1405, processing unit(s) 1410, a system memory 1415, a read-only 1420, a permanent storage device 1425, input devices 1430, output devices 1435, and may include a network interface 1440.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

I claim:

1. A first multi-therapeutic patient lift and parallel bars system in a lift/walker configuration, said first multi-therapeutic patient lift and parallel bars system comprising:

a parallel bars apparatus comprising a platform, a pair of laterally oriented parallel handrail bars, a plurality of vertically oriented parallel bar uprights, a bar adjustment motor, and a bar adjustment motor controller, wherein each parallel bar upright is connected at a lower end of the parallel bar upright to the platform and connected at an upper end of the parallel bar upright to a parallel handrail bar, wherein each parallel bar upright includes a sliding upright bar that changes a length of the parallel bar upright when moved vertically, wherein the bar adjustment motor raises and lowers the sliding upright bar of each parallel bar upright to raise and lower the parallel handrail bars when the bar adjustment motor is powered in response to a command from the bar adjustment motor controller;

a lift/walker assembly positioned on the platform of the parallel bars apparatus to aid a patient in standing within the pair of laterally oriented parallel handrail bars of the parallel bars apparatus, the lift/walker assembly comprising a frame, a lift strap, a lift adjustment motor, a lift adjustment motor controller, a kick plate, a knee pad, an adjustable height tray, a tray height adjustment motor, a tray height adjustment motor controller, a chest pad, a back pad, and a plurality of locking casters with wheels attached to a bottom of the frame, wherein the locking casters are configured to (i) lock the wheels in a locked configuration that secures the lift/walker assembly in a stationary position for upright stationary standing by the patient by preventing movement of the wheels under the frame of the lift/walker assembly and (ii) unlock the wheels in an unlocked configuration that releases the wheels for linear movement of the lift/walker assembly along the platform and within the laterally oriented parallel handrail bars during patient ambulation;

an end bar hook attached to a first vertically oriented parallel bar upright of the plurality of vertically oriented parallel bar uprights, wherein the first vertically oriented parallel bar upright is positioned along a first side of and at an end of the platform;

an end bar attached to a second vertically oriented parallel bar upright of the plurality of vertically oriented parallel bar uprights, wherein the second vertically oriented parallel bar upright is positioned along a second side of and at the end of the platform, wherein the end bar is configured to latch onto the end bar hook to prevent linear movement of the lift/walker assembly past the end bar during patient ambulation; and a storage hatch that opens to a sub-floor storage from within the platform, wherein therapy equipment used with the first multi-therapeutic patient lift and parallel bars system is stored in the sub-floor storage when not in use.

2. The first multi-therapeutic patient lift and parallel bars system of claim 1 further comprising a step system comprising a set of stairs that pop up from the sub-floor storage when the storage hatch is opened, wherein the step system provides a stepping activity for a patient between the parallel handrail bars.

3. The first multi-therapeutic patient lift and parallel bars system of claim 1 further comprising a ramp system comprising an incline that pops up from the sub-floor when the storage hatch is opened, wherein the ramp system provides a graded incline ambulation activity for a patient between the parallel handrail bars.

4. The first multi-therapeutic patient lift and parallel bars system of claim 1, wherein the lift strap lifts a patient from a seated position to a standing position when the lift strap is positioned under the rear end of the patient and the lift adjustment motor is powered in response to a command from the lift adjustment motor controller.

5. The first multi-therapeutic patient lift and parallel bars system of claim 1, wherein the adjustable height tray is raised and lowered by powered operation of the tray height adjustment motor in response to a command from the tray height adjustment motor controller.

6. The first multi-therapeutic patient lift and parallel bars system of claim 1 further comprising an abduction board that is positioned on the platform and runs an entire length of the parallel bars apparatus to prevent a patient standing and walking with the lift/walker assembly from moving feet in a scissoring pattern, wherein the kick plate includes an abduction board slot through which the abduction board fits to allow ambulation of the lift/walker assembly.

7. A second multi-therapeutic patient lift and parallel bars system in a standing frame configuration, said second multi-therapeutic patient lift and parallel bars system comprising:

a parallel bars apparatus comprising a platform, a pair of laterally oriented parallel handrail bars, a plurality of vertically oriented parallel bar uprights, a bar adjustment motor, and a bar adjustment motor controller, wherein each parallel bar upright is connected at a lower end of the parallel bar upright to the platform and connected at an upper end of the parallel bar upright to a parallel handrail bar, wherein each parallel bar upright includes a sliding upright bar that changes a length of the parallel bar upright when moved vertically, wherein the bar adjustment motor raises and lowers the sliding upright bar of each parallel bar upright to raise and lower the parallel handrail bars when the bar adjustment motor is powered in response to a command from the bar adjustment motor controller;

a standing frame positioned on the platform of the parallel bars apparatus to aid a patient in standing within the pair of laterally oriented parallel handrail bars of the parallel bars apparatus, said standing frame comprising a patient lift sling, sling hooks, sling motors, a removable tray, a tray attachment bar, a chest pad, a removable knee pad, a knee pad attachment bar, removable foot plate, a foot plate attachment bar, and a posterior foot strap;

a storage hatch that opens to a sub-floor storage from within the platform, wherein therapy equipment used with the second multi-therapeutic patient lift and parallel bars system is stored in the sub-floor storage when not in use; and a standing frame components storage box that stores the removable tray, the tray attachment bar, the chest pad, the removable knee pad, the knee pad attachment bar, the removable foot plate, the foot plate attachment bar, and the posterior foot strap when the standing frame is not in use by a patient, wherein the standing frame components storage box is positioned along one side of the parallel bars apparatus to clear the platform when the standing frame is not in use by the patient.

8. The second multi-therapeutic patient lift and parallel bars system of claim 7, wherein the removable knee pad is folded after removal and before storing in the standing frame components storage box, wherein the knee pad attachment bar includes a break in a middle part of the knee pad attachment bar to break the knee pad attachment bar into two bars that are stored in the standing frame components storage box.

9. The second multi-therapeutic patient lift and parallel bars system of claim 7, wherein the chest pad is attached to the removable tray, wherein the chest pad tucks under the removable tray and the tray attachment bar to store the chest pad with the removable tray and the tray attachment bar in the standing frame components storage box when the standing frame is not in use by the patient.

10. The second multi-therapeutic patient lift and parallel bars system of claim 7 further comprising a single step platform that pops up from the sub-floor when the storage hatch is opened, wherein the single step platform provides an aerobic stepping activity for a patient between the parallel handrail bars.

* * * * *